US010052774B2

(12) United States Patent
Giannelli et al.

(10) Patent No.: US 10,052,774 B2
(45) Date of Patent: Aug. 21, 2018

(54) RAZOR ACCESSORY

(71) Applicants: Gretchen Giannelli, Alexandria, VA (US); Vincenzo Giannelli, Alexandria, VA (US)

(72) Inventors: Gretchen Giannelli, Alexandria, VA (US); Vincenzo Giannelli, Alexandria, VA (US)

(73) Assignee: YORZ 4 RAZORS INC., Alexandria, CA (US)

( * ) Notice: Subject to any disclaimer, the term of this patent is extended or adjusted under 35 U.S.C. 154(b) by 0 days.

(21) Appl. No.: 14/805,434

(22) Filed: Jul. 21, 2015

(65) Prior Publication Data

US 2016/0368157 A1 Dec. 22, 2016

Related U.S. Application Data

(60) Provisional application No. 62/032,624, filed on Aug. 3, 2014.

(51) Int. Cl.
*B26B 21/40* (2006.01)
*A63B 49/08* (2015.01)

(52) U.S. Cl.
CPC ..... *B26B 21/40* (2013.01); *A63B 49/08* (2013.01); *B26B 21/4068* (2013.01); *Y10S 16/12* (2013.01)

(58) Field of Classification Search
CPC ..... B26B 21/40; B26B 21/4068; B26B 21/52; A63B 49/08; Y10S 16/12
USPC ..... 248/346.03; 30/527, 50, 526; 473/549; 16/DIG. 12; 74/563
See application file for complete search history.

(56) References Cited

U.S. PATENT DOCUMENTS 2,048,559 A * 7/1936 Muros ..... B26B 21/32 30/60.5
2,078,150 A * 4/1937 Masip et al. ..... B26B 21/16 30/32
2,173,451 A * 9/1939 Lorber ..... B43K 23/004 15/143.1
2,645,009 A * 7/1953 Hymen ..... B26B 21/52 30/536
2,852,114 A * 9/1958 Heit ..... A45C 13/26 16/406
3,010,204 A * 11/1961 Smith ..... B26B 21/40 30/537
3,111,757 A * 11/1963 Dubofsky ..... B26B 21/40 30/526

(Continued)

FOREIGN PATENT DOCUMENTS

CN 204147898 U 2/2015

OTHER PUBLICATIONS

Office Action from Chinese Patent App. No. 201610500323.6 (dated Sep. 29, 2017).

*Primary Examiner* — Anita M King
(74) *Attorney, Agent, or Firm* — Cermak Nakajima & McGowan LLP; Adam J. Cermak

(57) ABSTRACT

A razor accessory that receives a handle of a razor includes a body with a rounded exterior surface and a rectangular channel interior with flat walls to define a rectangular channel from a first end of the body and terminating at a second end of the body and a slit through the body in an axial direction relative to a central axis of the body from the first end of the body toward the second end of the body. The handle of the razor is received by the body with a sliding motion of an end of the handle into the rectangular opening at the first end of the body.

1 Claim, 10 Drawing Sheets

(56) References Cited

U.S. PATENT DOCUMENTS

| | | | | | |
|---|---|---|---|---|---|
| 3,137,939 | A * | 6/1964 | Waldeck | B26B 21/40 | 30/346.52 |
| 3,180,528 | A * | 4/1965 | Balint | B65D 51/242 | 206/806 |
| 4,283,808 | A * | 8/1981 | Beebe | A46B 5/02 | 15/145 |
| 4,905,372 | A * | 3/1990 | Willis | B26B 21/523 | 30/537 |
| 4,974,286 | A | 12/1990 | Stowell et al. | | |
| 5,860,190 | A * | 1/1999 | Cano | A47G 21/02 | 16/422 |
| 5,915,433 | A * | 6/1999 | Hybler | A46B 5/02 | 15/111 |
| RE37,190 | E * | 5/2001 | Stowell | B25G 1/10 | 16/110.1 |
| 6,263,582 | B1 * | 7/2001 | Wade | B26B 21/40 | 30/537 |
| 6,266,888 | B1 * | 7/2001 | Zowaski | B26B 21/523 | 30/527 |
| 6,367,854 | B1 * | 4/2002 | Chou | A01B 1/227 | 294/57 |
| 6,869,054 | B1 * | 3/2005 | Pearsall | B42D 17/00 | 232/1 C |
| D624,264 | S * | 9/2010 | Li | D32/51 | |
| 7,891,616 | B2 * | 2/2011 | Pinchuk | A47G 1/20 | 248/206.5 |
| 8,844,099 | B2 * | 9/2014 | Puig | B25G 1/102 | 16/422 |
| 9,108,329 | B2 * | 8/2015 | Stiles | B26B 21/22 | |
| 2003/0208913 | A1 * | 11/2003 | Paquette | A45D 27/29 | 30/526 |
| 2016/0167216 | A1 * | 6/2016 | Ou | B25G 1/10 | 81/489 |

* cited by examiner

RAZOR ACCESSORY

CROSS REFERENCE TO RELATED APPLICATIONS

This utility patent application claims priority to U.S. provisional patent application 62/032,624 filed on Aug. 3, 2014, which is incorporated by reference herein.

TECHNICAL FIELD

The technology of the invention relates to shaving razors and accessories for shaving razors.

BACKGROUND

Multi-pack disposable shaving razors are a popular low cost option for shaving needs. Each disposable razor can typically be used several times before it is discarded.

In some instances, multiple users each have a disposable razor and share a bathroom. For hygiene and other purposes it is desirable that razors not be shared. For example, razor blades can spread infections such as warts, which are caused by a virus, folliculitis, which is typically caused by staph bacteria, or jock itch, which is a fungal infection. This is because shaving creates microscopic openings in the skin, which allow organisms to enter and spread infection. And, although they're usually spread by direct contact, the viruses that cause herpes and hepatitis can also linger on razor blades or in the moist areas between blades.

There is also less risk of nicks or dry, flaky skin—if a sharp razor is used to "skim" the skin instead of tugging against it. A general rule of thumb is to replace the razor after a certain number of uses and this can be tracked more easily if the razor is not shared.

It is also desirable to store the razor in a dry and hygienic environment to prevent or reduce the growth of organisms on the blade. Keeping the razor from sitting in pooled water may also extend the life of the blades by slowing down oxidation (rust) on blades and prevent the lubricating strip from getting soaked and/or from sticking to bathroom surfaces.

SUMMARY

The integrated razor accessory having multiple embodiments described in this application provides a number of benefits. The accessory (or cover) can be used to uniquely identify a shaving razor by having a cover with a unique design or color. The combination of visually selecting a color and manually inserting the razor handle into the accessory increases the likelihood of recognition of this personal item. This may prevent accidental sharing of razors and thus help prevent the spread of infections. The accessory comprises an extension to fasten or secure the device to an edge, hook or shower caddy, which also improves hygiene since the unit can be stored by hanging it in a dry place, away from wet areas where bacteria and viruses tend to thrive. The accessory also helps slow down rust formation.

In one general aspect, the razor accessory includes a handle having a channel to receive a razor handle along the length of the handle and an extension protruding from a distal end of the handle. Embodiments may include one or more of the following features.

For example, the handle may have a wavy, straight, or curved edge. The handle can be made of a semi-rigid plastic of variable hardness. The extension on the accessory may be used to store the razor and it may include a hook portion, an oval portion or a cut-out area and/or a magnet. The channel may be rectangular or circular.

The proximal end of the handle can have a narrow neck. Resilient ribs may also be on the handle inside the channel to secure, by resistance, the cover to a disposable razor handle.

In another general aspect, a razor accessory to receive a handle of a razor includes an elongated body with a rounded exterior surface and having a rectangular channel defined by flat inner walls, the channel extending in an axial direction relative to a central axis of the body from a first end of the body and terminating proximate to a second end of the body and a slit through the body in an axial direction relative to a central axis of the body from the first end of the body and terminating proximate to the second end of the body. The handle of the razor is received within the body by inserting an end of the handle into a rectangular opening of the channel and sliding motion of the handle toward the second end of the body.

Embodiments may include one or more of the above or following features. For example, the second end of the body may include a closed wall and the sliding motion of the end of the handle terminates when the end of the handle makes contact with the closed wall.

As another feature, a hooked portion may extend from the second end of the body. A port may also be located at a base of the hooked portion. A relatively flat portion may extend between the second end of the body and the hooked portion.

The rounded exterior surface of the body may include a wavy grip portion configured to aid a user in gripping the razor accessory. The accessory can be made of a resilient material, such as, for example, silicon rubber such that edges of the slit are moved to an opened position to accommodate the handle of the razor and the edges are released to secure the handle of the razor in the accessory.

As another feature, a pair of arms may be attached to a second end of the body and a hooked portion attached to the pair of arms. There may be a port defined between the pair of arms and a base of the hooked portion.

In addition, the rectangular interior surface can include one or more flat walls. One or more of the flat walls may have a series of ribbed protrusions. A magnet may be attached to or embedded in the body.

In still another general aspect, a razor accessory to receive a handle of a razor includes an elongated body having a channel inside the body along an axial direction relative to a central axis of the body from a first end of the body and terminating proximate to a second end of the body, a slit through the body in an axial direction relative to a central axis of the body from the first end of the body and terminating proximate to the second end of the body, a hooked portion extending from the second end of the body and a port through a base of the hooked portion.

Embodiments may include one or more of the above or following features. For example, the elongated body can have a rounded exterior surface that includes a wavy grip portion configured to aid a user in gripping the razor accessory. The elongated body may include flat outer walls to define a rectangular shape. The channel may also have flat inner walls to define a rectangular channel or a circular inner wall to define a cylindrical channel.

In a further general aspect, a razor accessory to receive a handle of a razor includes an elongated body comprised of a resilient material with a rounded exterior surface that includes a wavy grip portion configured to aid a user in gripping the razor accessory and having a rectangular channel defined by flat inner walls, the channel extending in an axial direction relative to a central axis of the body from a first end of the body and terminating proximate to a second end of the body, a slit through the body in an axial direction relative to a central axis of the body from the first end of the body and terminating proximate to the second end of the body a hooked portion extending from the second end of the body and a port through a base of the hooked portion. One or more of the flat inner walls may include a series of ribbed protrusions that partly extend into the channel. Embodiments may also include one or more of the above features.

DETAILED DESCRIPTION

Figure 1:
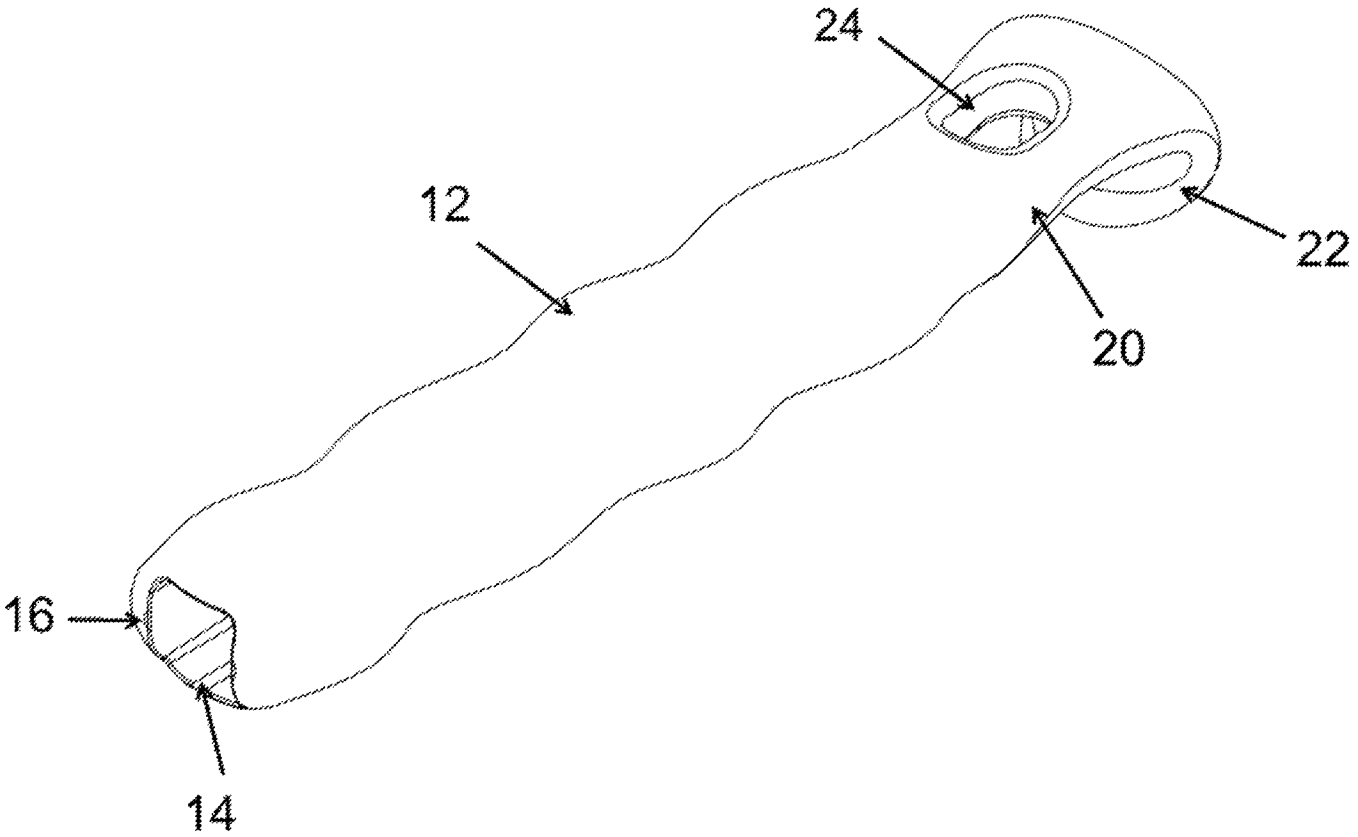
FIGS. 1-3 show perspective, side and bottom views a razor accessory, respectively.

The invention, as shown in the drawings, is a razor cover having a sleeve or body to receive a handle of a razor, particularly a disposable razor. The razor accessory essentially wraps around the handle of the disposable razor so only the razor's neck and head are exposed.

The objective is to allow the user to select a personalized razor accessory that can prevent hygiene issues associated with the accidental sharing of disposable razors—a practice that can spread infection; and, be hung on a shower caddy, hook or edge thus prolonging the life of the blade and preventing hygiene issues associated with storing the razors in pooled water where bacteria and viruses thrive.

Figure 2:
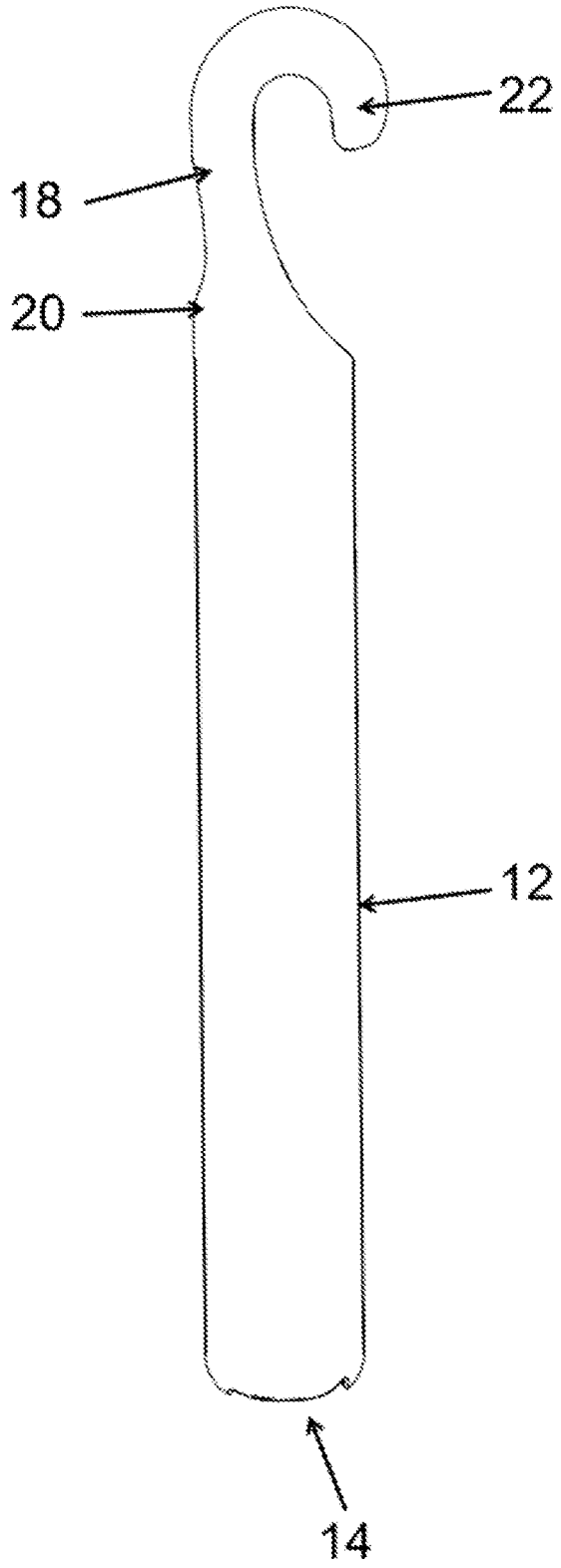
Figure 3:
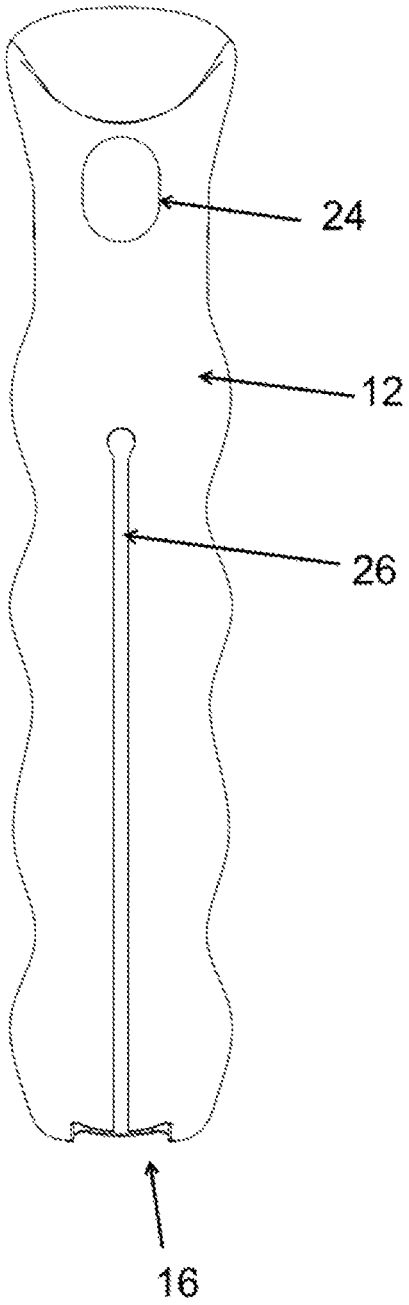

A first embodiment is shown in FIGS. 1-3. The razor accessory 10 has an elongated body 12 with a rounded or wavy exterior surface. The body 12 acts as a handle and the wavy surface conforms to the hand and provides an easier and more comfortable grasp while using the razor accessory 10.

A rectangular channel 14 extends through the inside of the body 12. The rectangular channel is open at a first end of the body to define a neck 16 and terminates near the second end of the body.

An attachment device 18 with a base 20 extends from the second end and terminates as a hooked portion 22. A port 24 passes through the base 20.

Referring to FIG. 3, a slit 26 extends through the body from the exterior surface into the channel 14 in an axial direction from the neck 16 and terminates near the second end of the body.

Figure 4:
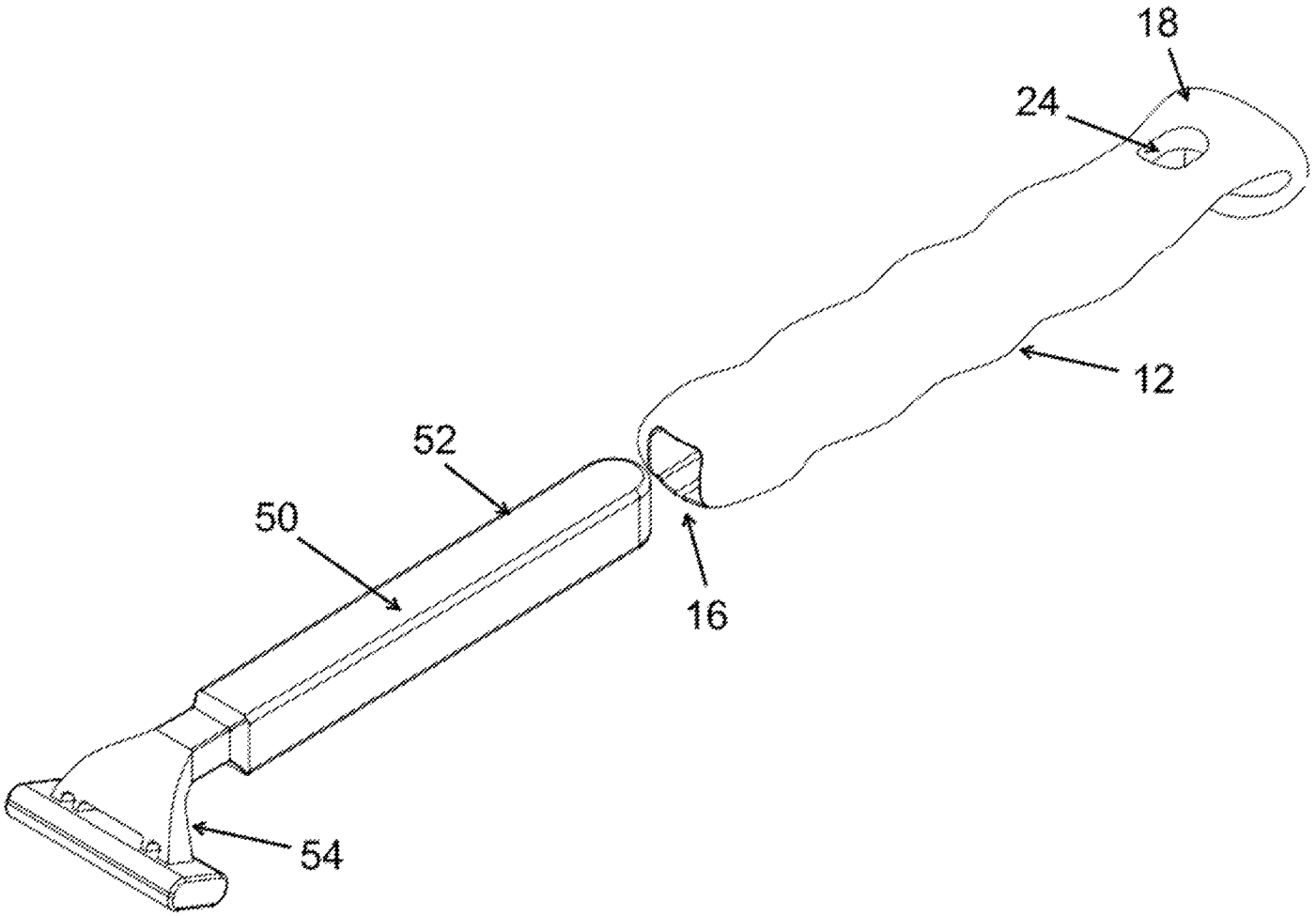
FIG. 4 shows a razor prior to insertion of the handle into the razor accessory.
Figure 5A:
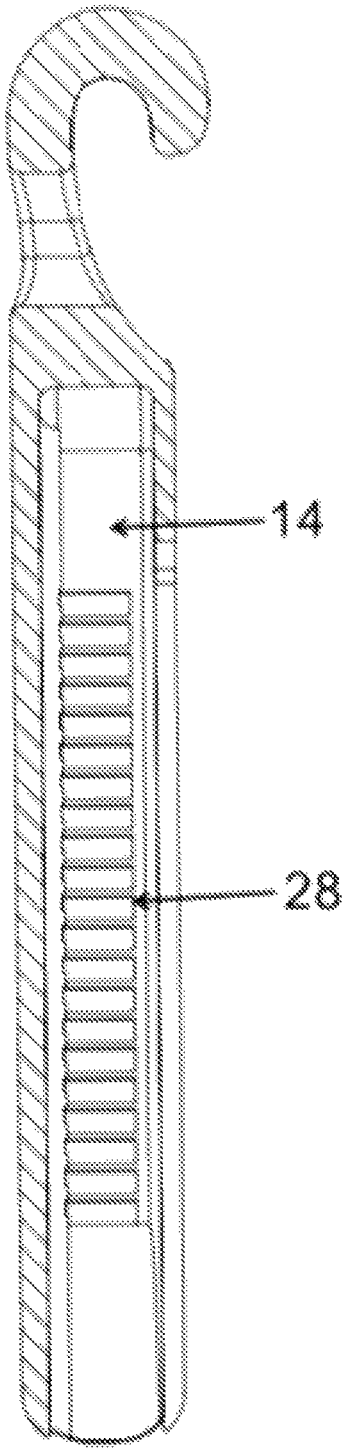
FIG. 5A shows a cross-sectional view of the razor accessory at line A-A in FIG. 5B.
Figure 5B:
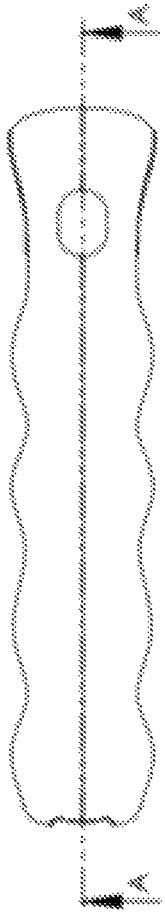
FIG. 5B shows a top plan view of the razor accessory.
Figure 6:
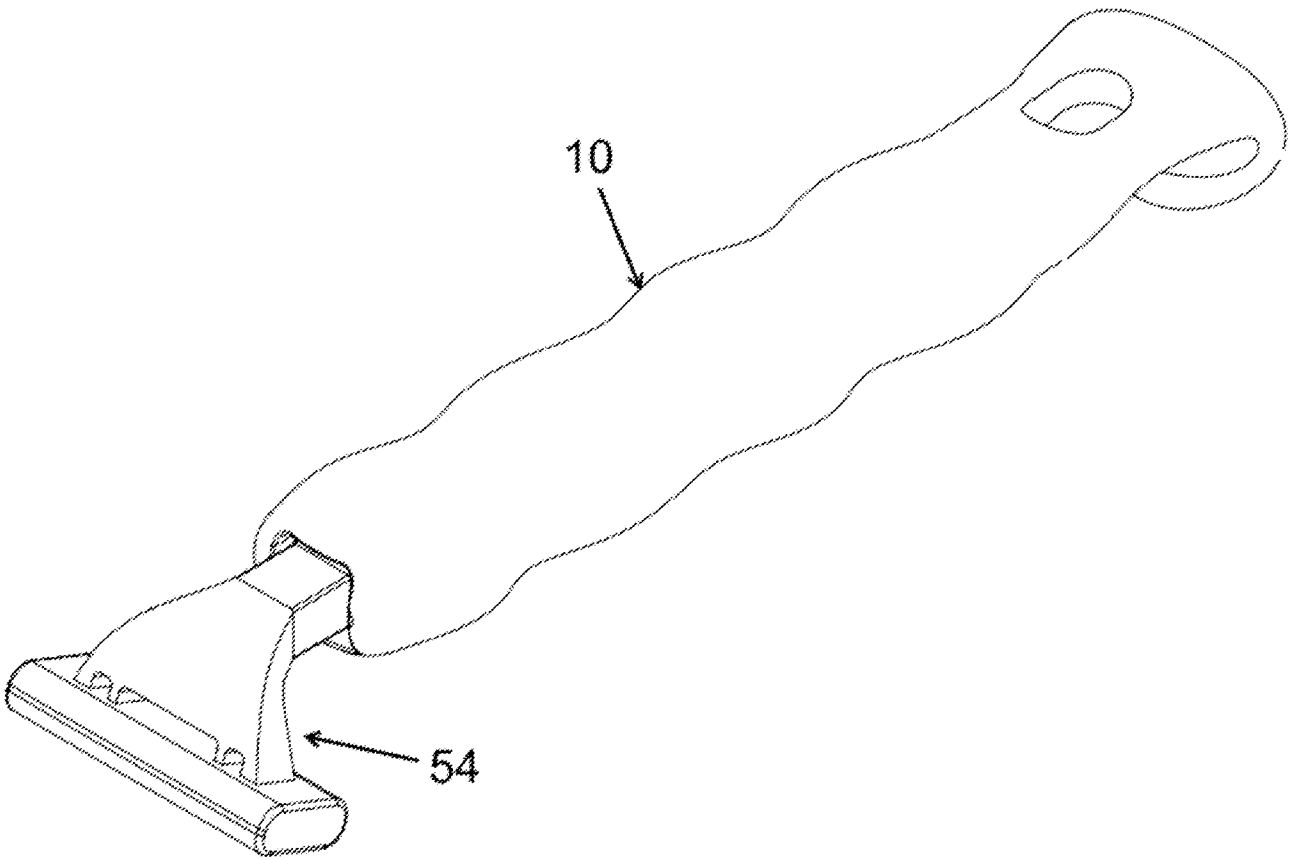
FIG. 6 shows a razor handle inserted into the razor accessory.

FIGS. 4-6, show how razor 50 is secured by the razor accessory 10. Referring to FIG. 4, the razor 50 is positioned with the handle 52 toward the neck 16 and the head 54 of the razor 50 away from the neck 16.

The razor accessory 10 is made of a resilient material, such as, for example, silicone rubber. Referring to FIG. 4, the razor handle 52 can be pushed into the channel of the body 12 so that it is secured by the accessory 10. The slit 26 can be opened slightly to make it easier for the razor handle 52 to slide into the channel 14.

Referring to FIG. 5 is a cross-sectional view along the line A-A as shown with arrows. As shown, the channel 14 has a series of ribs or ridges 28 on one or more of its surfaces. As shown in FIG. 6, once the slit 26 is released, it essentially envelopes the razor handle 52 and the ribs 28 create additional friction to prevent the handle 52 from sliding out of the channel. Thus it remains tightly secured for ease of use.

Figure 7:
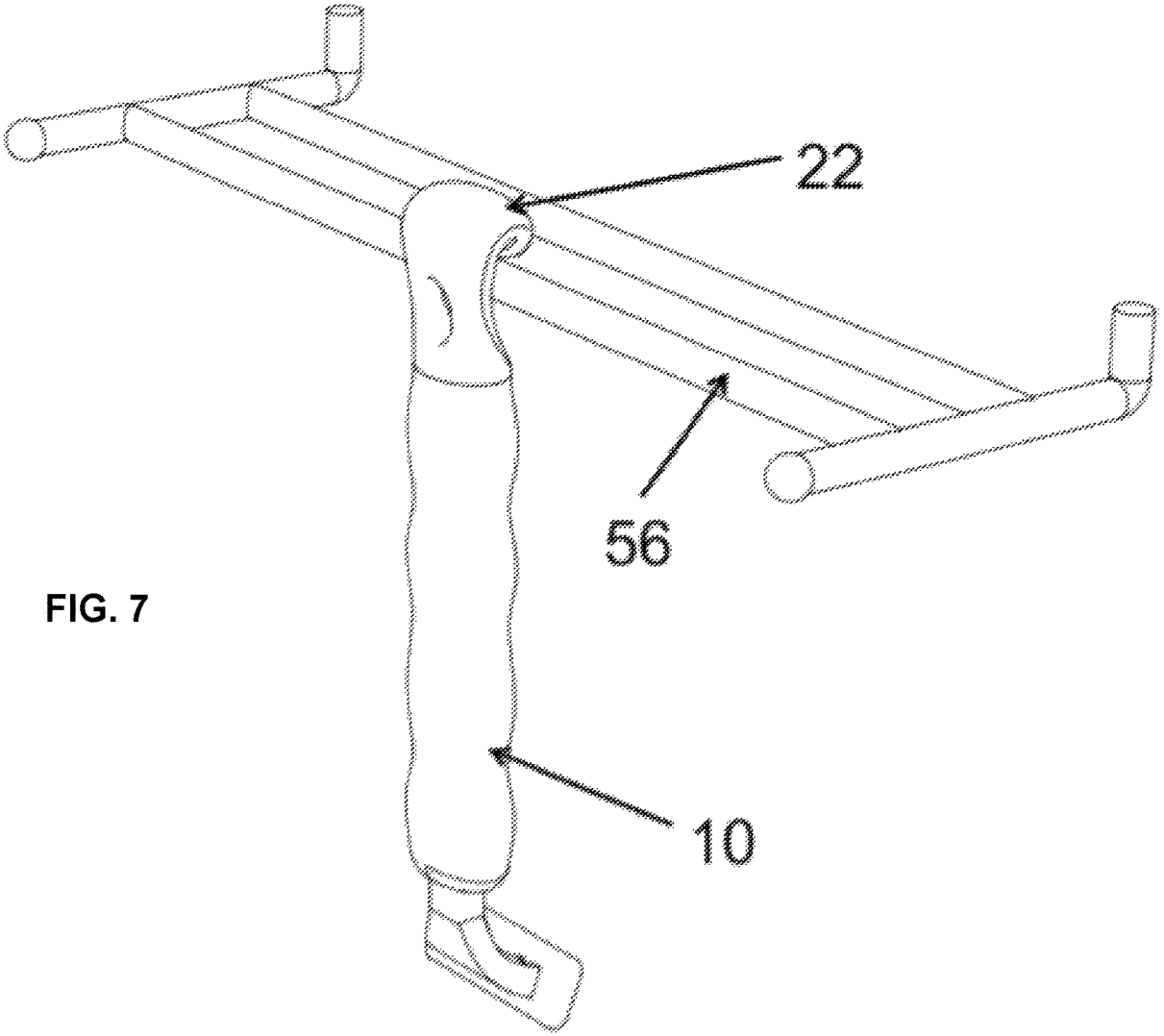
FIGS. 7 and 8 show the razor accessory hanging from a shelf.
Figure 8:
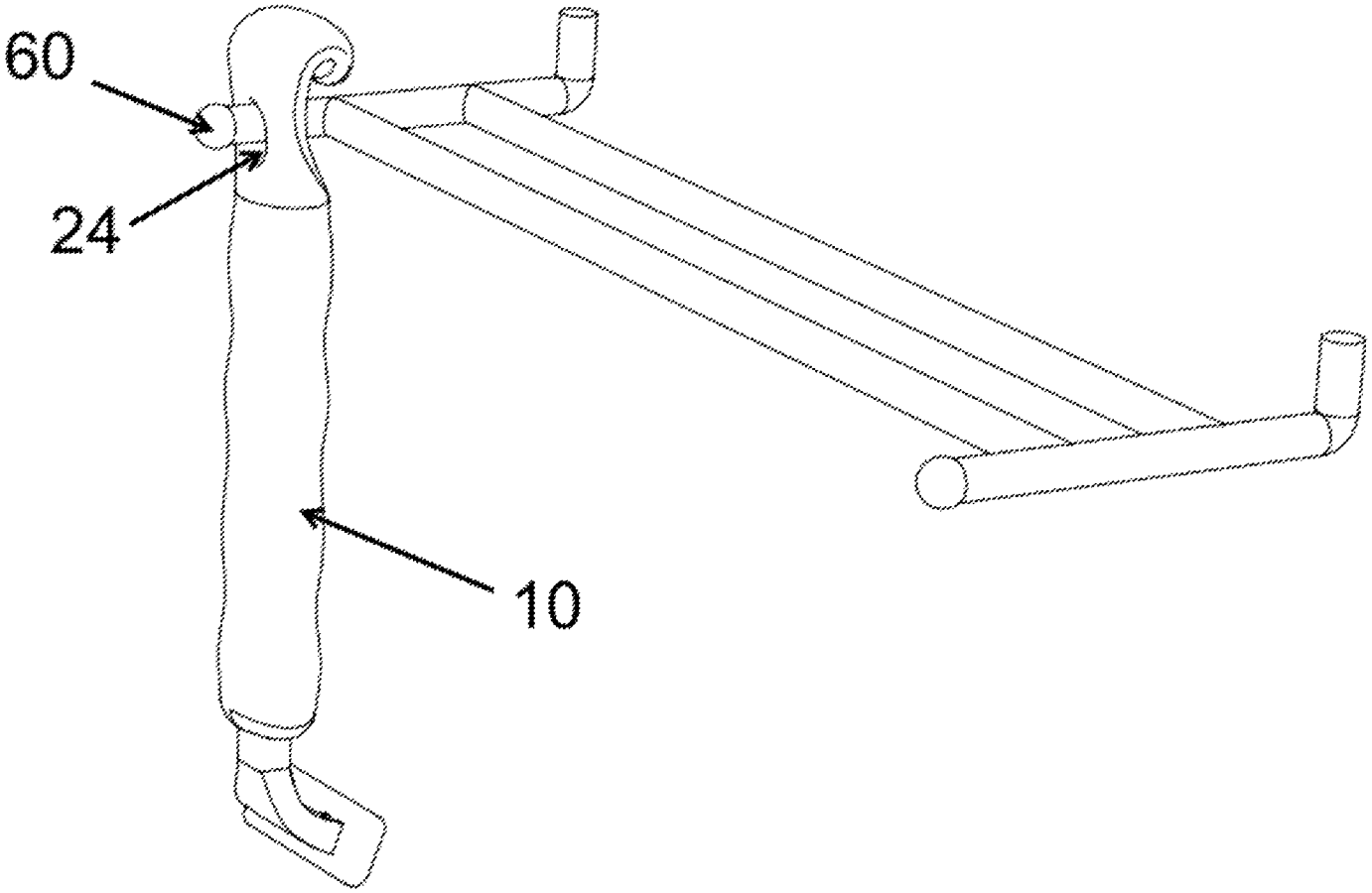

FIGS. 7 and 8 show some of the storage options for the razor accessory 10. For example, the hooked portion 22 can be secured to a wire shelf 56 as shown in FIG. 7. Alternatively, the port 24 can be used to hang the razor accessory 10 from a rod 60 or other protrusion.

Figure 9:
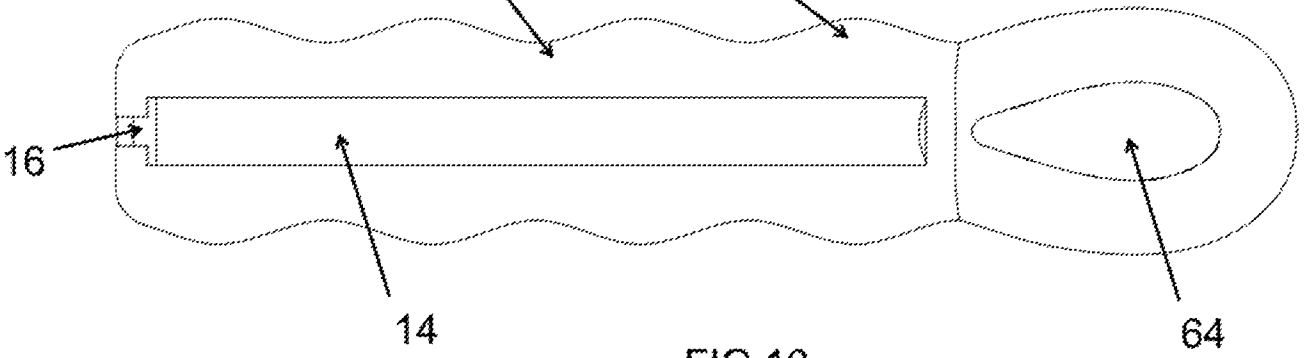
FIGS. 9 and 10 show side and bottom views of a second embodiment of the razor accessory.
Figure 10:
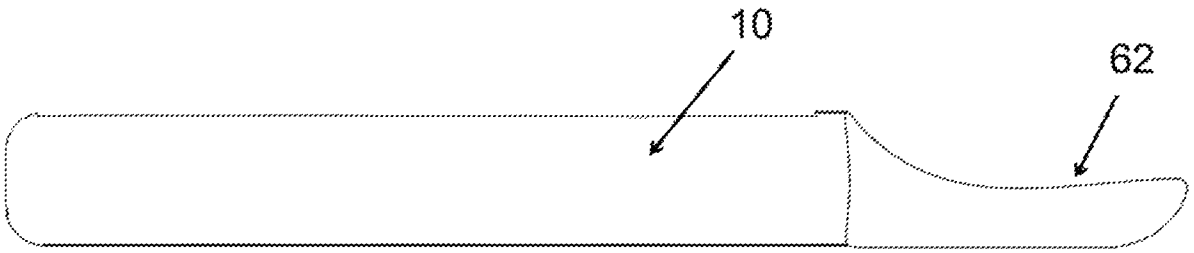

FIGS. 9 and 10 illustrate a second embodiment of the razor accessory 10. In the second embodiment, the second end has a looped portion 62 with an opening 64 that can be used to hang or secure the accessory 10.

Figure 11:
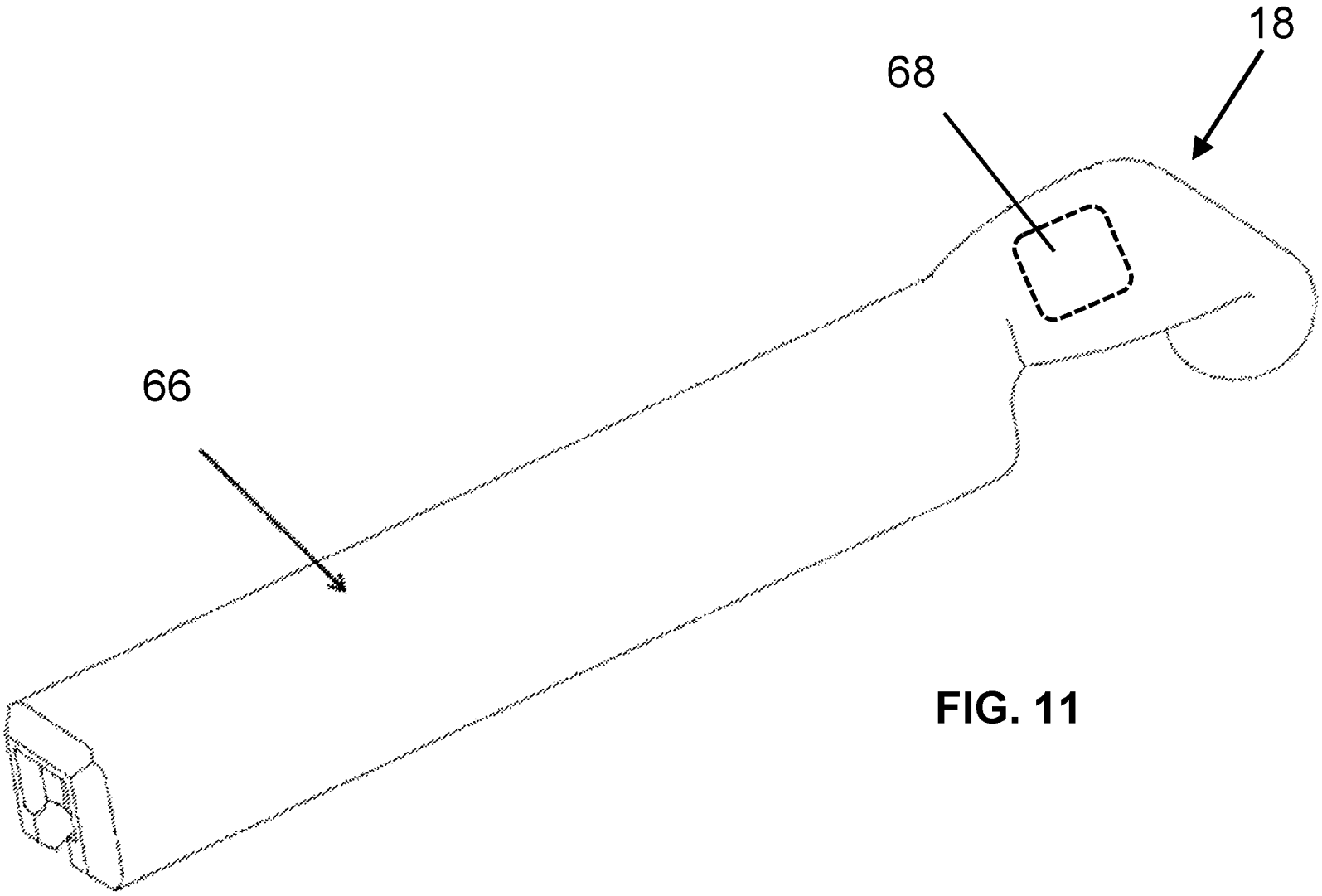
FIG. 11 shows a perspective view of a third embodiment of the razor accessory.

FIG. 11 is another embodiment of the razor accessory 10. The body 12 has flat outer walls 66 to give it a rectangular outer appearance. The base of the fastening device 18 has an embedded or attached magnet 68.

The various embodiments allow the owner to choose a razor cover that is most effective and useful. Additional features that provide greater user flexibility and resistance to infection include a travel cover made from silica gel that wraps around the razor head. Suction cups can also be attached along the length of the cover with better attachment to non-metallic surfaces like tiles. In addition, a bactericidal agent may be embedded in the accessory 10.

The invention claimed is:

1. A razor accessory useful to receive a handle of a razor, comprising:

an elongated body with an exterior surface and having a rectangular channel defined by flat inner walls, the channel extending in an axial direction relative to a central axis of the body from a rectangular opening of the channel at a first end of the body and terminating proximate to a second end of the body;

a slit through the body in the axial direction relative to the central axis of the body from the first end of the body and terminating proximate to the second end of the body;

a relatively flat portion extending from the second end of the body; and a hooked portion extending from the flat portion;

wherein the handle of the razor can be received within the body by inserting an end of the handle into the rectangular opening of the channel and sliding the handle toward the second end of the body.

* * * * *